United States Patent [19]

Carson

[11] 4,069,862

[45] Jan. 24, 1978

[54] CONTINUOUS CASTING MOLD WITH HORIZONTAL INLET

[75] Inventor: John W. Carson, Richmond, Va.

[73] Assignee: Reynolds Metals Company, Richmond, Va.

[21] Appl. No.: 728,770

[22] Filed: Oct. 1, 1976

[51] Int. Cl.[2] ..... B22D 11/10

[52] U.S. Cl. ..... 164/439; 164/444

[58] Field of Search ..... 164/281 R, 281 H, 283 R, 164/283 M

[56] References Cited

U.S. PATENT DOCUMENTS

| | | | |
|---|---|---|---|
| 3,286,309 | 11/1966 | Brondyke et al. | 164/281 H X |
| 3,834,446 | 9/1974 | Medovar et al. | 164/281 R |
| 3,885,617 | 5/1975 | Foye | 164/283 |

FOREIGN PATENT DOCUMENTS

| | | | |
|---|---|---|---|
| 1,136,453 | 9/1962 | Germany | 164/281 |
| 100,032 | 4/1942 | Netherlands | 164/283 |

*Primary Examiner*—Robert D. Baldwin

*Attorney, Agent, or Firm*—Glenn, Lyne, Gibbs & Clark

[57] ABSTRACT

A non-turbulent, level pour feeding of molten metal into a continuous-casting mold is provided through inlets formed in heat insulated blocks positioned at opposite shorter sides of the mold for casting large rectangular aluminum ingots. The heights of inlet passages are designed to clean impurities from molten metal. The longer sides of the mold are cooled to a higher level than the shorter sides.

15 Claims, 10 Drawing Figures

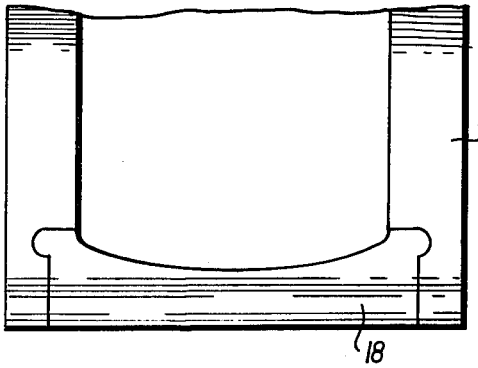
FIG. 8
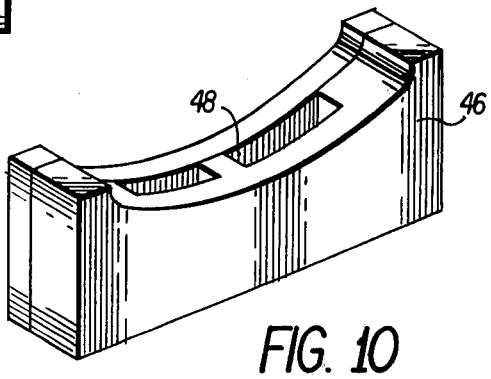
FIG. 10
FIG. 9
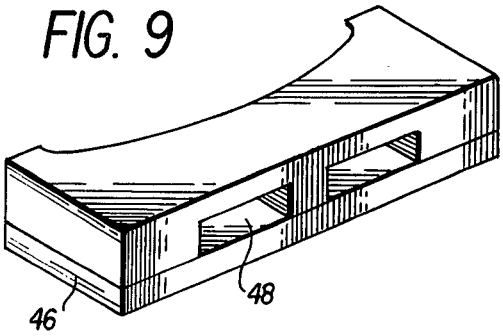
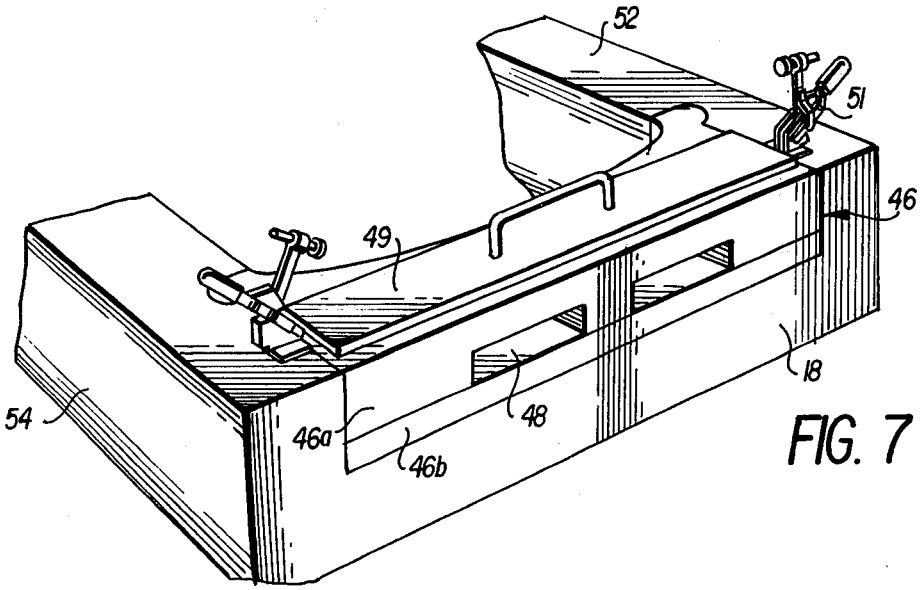
FIG. 7

CONTINUOUS CASTING MOLD WITH HORIZONTAL INLET

BACKGROUND OF THE INVENTION

As used herein, "aluminum" means aluminum and aluminum based alloys, and "continuous casting" includes casting ingots of limited length.

The most widely used commercial practice of vertical continuous casting of aluminum is to feed aluminum vertically down along a central axis of a mold to a level control device having outlets through which the molten aluminum passes at the top of an ingot being cast in the mold. The mold has vertical, chilled, metal walls, and the ingot emerging beneath the mold is directly chilled by water spray. This system is disclosed in Ennor U.S. Pat. No. 2,301,027, and is commonly referred to as "DC Casting."

One of the variants of DC casting is the casting system illustrated in Moritz U.S. Pat. No. 2,983,972. The Moritz patent teaches the use of insulation within a mold to control the level of the "freeze line," and also teaches feeding molten aluminum from the side of the mold, to reduce turbulence and avoid some of the practical problems associated with use of a vertical feed system required in practice of conventional DC casting systems. The Mortiz casting system is still in successful commercial use, but wider adoption of this system has been hampered by difficulties in using available insulating materials, which have limited service life and have had a tendency to break off to appear as undesirable inclusions in the ingots or to cause ingot surface defects such as tearing.

A great many other variants in continuous casting practices have been tried and disclosed, but the art has continued looking for better combinations of features to provide an improved continuous casting system which more nearly satisfies commercial requirements than what has been generally used heretofore. It is an object of this invention to provide such a system.

SUMMARY

The present invention contemplates side feeding of a DC-type mold in such manner that molten metal turbulence is minimized and the chances of oxide inclusions in the ingots are thereby reduced. This is accomplished through a selection and arrangement of materials or components which can safely be in contact with the stream of molten metal. With the practice of this invention it has been found unnecessary to provide an insulating lining around the mold for purposes of controlling the freezing level. In order to achieve the desired results, molten metal is fed from opposite sides of the mold, and this can be done successfully notwithstanding the fact that the effective length of the mold beneath the feed inlets is shorter than the effective length of the rest of the mold.

DESCRIPTION OF THE DRAWINGS

The accompanying drawings show schematically a present preferred embodiment of the invention in which:

FIG. 7 is a perspective view, partially broken away, showing an inlet block at a shorter end of the mold, and a cover plate and clamping arrangement to hold the block in place;

FIG. 8 is a plan view of one end of the mold showing how the mold is notched to receive an inlet block; and FIGS. 9 and 10 are perspective simplified views showing details of the construction of an inlet block.

DESCRIPTION OF ILLUSTRATED EMBODIMENT

Figure 1:
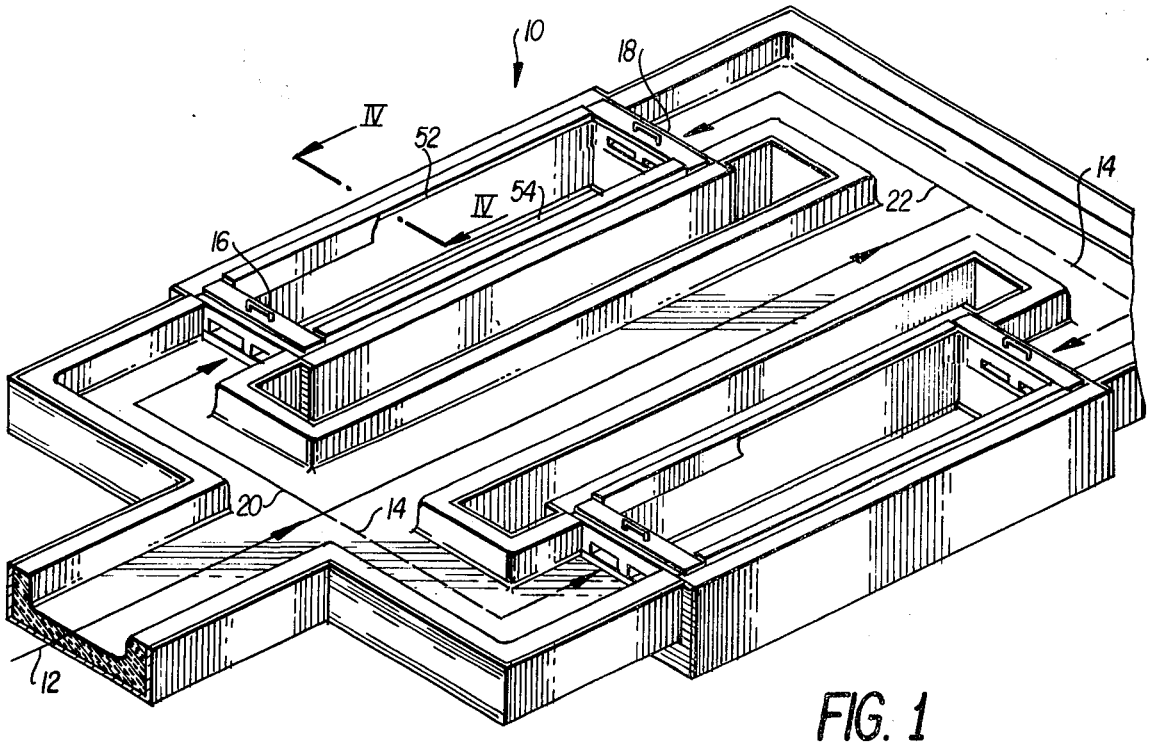
FIG. 1 is a simplified perspective view of a casting mold embodying the invention, showing the feed of molten metal to the mold.

Referring now more particularly to the accompanying drawings and initially to FIG. 1, there is shown a generally rectangular mold 10 and an associated trough system to supply molten aluminum to the mold from a source indicated by the arrowed line 12. Part of this aluminum may be supplied to adjacent molds, as indicated by the arrowed lines 14, and the part fed to the mold is divided and enters the mold across its opposite shorter sides, 16 and 18, as indicated by the arrowed lines 21 and 22.

Figure 2:
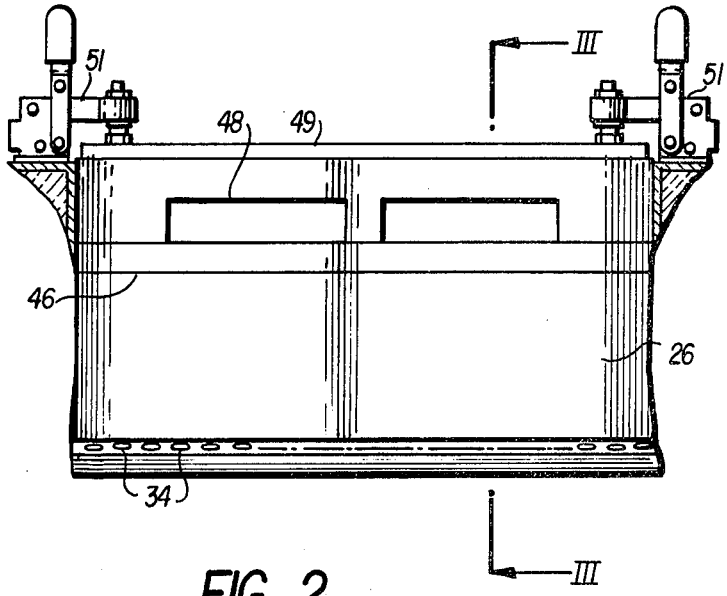
FIG. 2 shows a side elevation of the shorter end portion of the mold shown in FIG. 1, omitting the ingot and taken from inside the mold.
Figure 3:
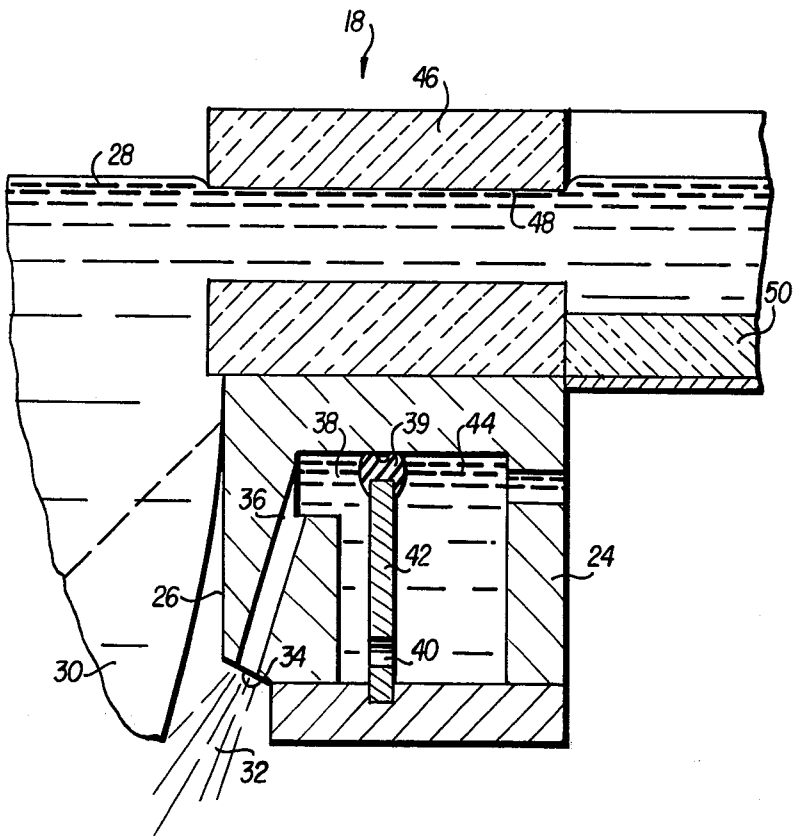
FIG. 3 is a fragmented section taken on the line III—III in FIG. 2, showing also adjacent portions of a feed trough and an ingot partially broken away.

Referring now to FIGS. 2 and 3, each of the shorter sides 16 and 13 of the mold has the same construction, and the side 18, for example, as shown in FIG. 3, comprises a mold wall 24, preferably made of a metal of high thermal conductivity, such as aluminum. The mold wall 24 has a chilled face 26 against which the molten aluminum 28 fed into the mold is initially solidified to form a solid ingot 30. Water or other coolant 32 is sprayed onto the solidified ingot 30 from a row of holes 34 located immediately beneath the lower edge of the mold face 26. The holes 34 are connected by passages 36 to an inner supply manifold 38 connected by passages 40 through a partition 42 having a resilient sealing strip 39, with an outer manifold 44 extending along the wall 24. This arrangement helps to keep the spray from each of the holes 34 substantially uniform in amount across the whole length of the mold face 26. It will be understood, of course, that the holes 34 may be in the form of a continuous slot, and that it would be possible, although usually not preferable, to omit the manifolds and holes and simply spray water against the back of the mold face 26 and directly against the ingot 30.

A block 46 is inserted in a notch cut for that purpose in the solid metal upper portion of the mold wall 24 above the level of the water manifolds 38 and 44. One or more horizontal passageways 48 are formed in the block 46 to convey the infeed of molten aluminum 22 into the pool of molten aluminum 28 above the ingot 30. The upper surfaces of these passageways may be high enough to clear the top level of the molten metal, so that the bottom surfaces of the passages act as weirs. However, positioning the top surfaces of the passages 48 just below the level of the molten metal, which is at substantially the same level at the opposite ends of the passages 48, may be desirable for purposes of skimming off any solid oxide floating at the top of the incoming molten metal 22, thus providing an underpour flow into the mold. The bottom surfaces of the passages 48, in another embodiment, are substantially flush with the upper surface of the bottom of the trough 50 conveying the molten metal 22 into the passages 48, although it is not depicted this way in the drawings.

The block 46 is ideally made of an insulating material, of suitable characteristics and cost. Desired characteristics are non-wettability in molten aluminum, ease of fabrication, ability to be heated to the molten metal temperature without out-gassing, and structural integrity so that particles of the block do not become detached and thus enter the molten metal 28 in the mold. At the present time the preferred material for the block 46 is an asbestos board such as "Marinite" sold by John Mansville Corporation.

In one embodiment, the block 46 is formed of two separate pieces, namely, an upper, E-shaped piece **46*a* and a lower flat piece 46*b***.

A cover plate 49 (having associated clamps 51) is preferably placed over the block 46 to hold it in place and thus prevent molten aluminum from entering a crevice between the block and the mold.

Figure 4:
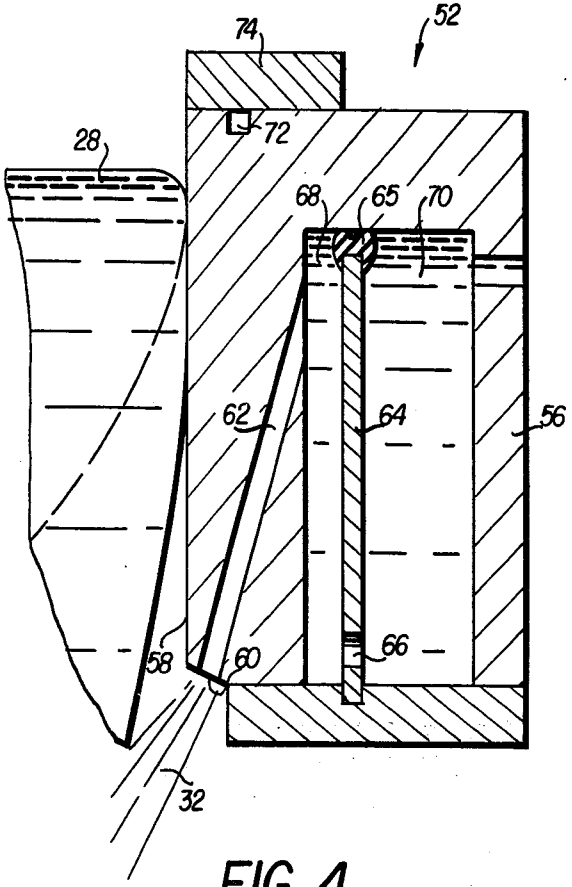
FIG. 4 shows a fragmented section taken on the line IV—IV in FIG. 1, and an adjacent portion of the ingot, partially broken away.
Figure 5:
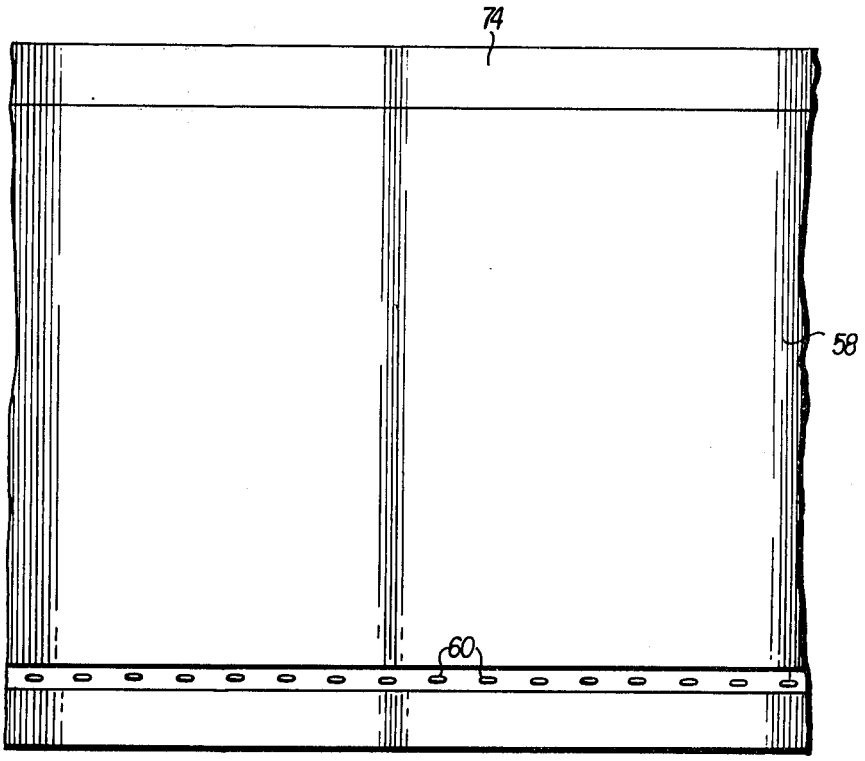
FIG. 5 shows a side elevation of the longer side portion of the mold shown in FIG. 4, partially broken away and omitting the ingot, taken from the inside of the mold.

Referring now to FIGS. 4 and 5, each of the opposite longer sides 52 and 54 of the mold has the same construction, and the side 52, for example, as shown in FIG. 4, comprises a metal mold wall 56 having an inner chilled face 58, spray holes 60, passages 62, partition 64, resilient sealing strip 65, partition openings 66, and manifolds 68 and 70 similar to the above-described corresponding elements of the short mold side 18. However, the manifolds 68 and 70 and the inlets of passages 62 extend close to the top of the wall 56, so that the chilled face 58 is cooled to a higher level than the corresponding chilled face 26 of the shorter mold side 18. Consequently, the molten metal 28 initially chills into solid metal to form the upper edge of the ingot 30 at a higher level along each of the longer mold sides 52 and 54 than the level of initial freezing against the chilled faces 26 of the shorter mold sides 16 and 18. However, the bottom levels of the chilled faces 26 of the shorter mold sides 16 and 18, and the bottom levels of the chilled faces 58 of the longer mold sides 52 and 54, are the same all around the mold 10, and the same is true of the levels of all of the spray openings 34 and 60.

The manifolds of each of the four sides of the mold are preferably controlled by separate adjustable valves, and all of the cooling liquid comes from a common source controlled by a main valve. The valves controlling the opposite mold sides are adjusted so that each of the two opposite sides put the same amount of spray on the ingot, and the sprays of the two shorter sides and the two longer sides are adjusted relative to each other so that the ingot 30 will be chilled properly all around, in spite of the relative short mold length along the short sides of the mold. A steady pre-determined drop rate of the ingot is matched by a steady supply of molten metal to keep the level of molten metal substantially constant while the ingot drops. It may be noted, further, that the freeze line along the longer mold sides 52 and 54 is close to the top level of the pool of molten aluminum 28 above the ingot, while the freeze line against the shorter sides 16 and 18 extends just below the lower surface of each of the blocks 46, and progressively rises on both sides of each of the blocks 46 until the freeze line at each of the corners of the mold is at substantially the same level as the freeze line along the longer sides of the mold. Notwithstanding this uneven chill line, the mold has proven successful in operation when using a number of alloys, such as 6063, 2024, and 7075, and the non-turbulent opposite feed of the molten metal into the mold minimizes the possibility of any oxide floating or molten metal 28 being swirled into the newly forming portions of the ingot.

While the mold can be used without continuous lubrication, simply by swabbing the inside surfaces of the mold with grease before initiating the casting operation, it is preferable to used continuous lubrication, at least along the two longer sides 52 and 54 of the mold. Accordingly, a groove 72 may be cut in the upper surface of the mold wall 56 (FIG. 4) to provide a lubricant manifold and a cover plate 74 secured over the top of the groove 72, extending to the plane of the chilled mold face 58. Either or both of the bottom surface of the plate 74, or the top surface of the mold wall 56, are lightly indented to provide fine passageways extending from the groove 72 to the top of the chilled mold face 58. Lubricant under pressure flows through the passages thus provided, and the emerging lubricant flows down the face 58 and thus provides a constant replenishment of lubricant between face 58 and molten metal 28 to minimize sticking of the solidified upper edge of the ingot 30 against the face 58. No such continuous lubrication system is illustrated for the two shorter mold sides 16 and 18, because this has not thus far been found necessary. However, the addition of similar continuous lubrication could be provided for the shorter mold sides. Another groove like groove 72 could also be provided beneath the feed block 46 if such continuous lubrication beneath the feed block should be found desirable in any particular case.

Figure 6:
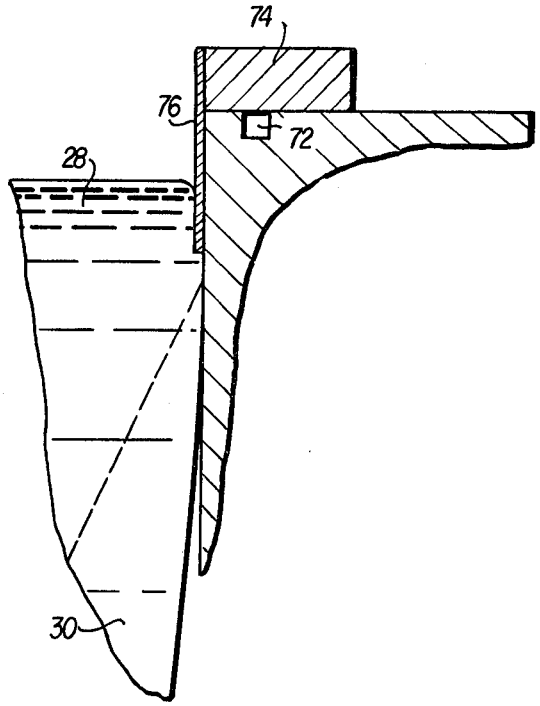
FIG. 6 shows an enlarged detail of part of the mold shown in cross section in FIG. 4, partially broken away and including a strip of insulating material along an upper portion of the inside wall of the mold.

Other modifications may be used, to further improve the performance of the mold in particular applications. For example, strips of paper-like insulating material, such as Fiberfrax, may be applied to particular portions of the mold faces 26 and 58, particularly along the upper portions of the longer mold sides 52 and 54, as illustrated in FIG. 6. As shown in that figure, a strip of insulating material 76 is adhered to an upper portion of the chilled mold face 58 and the adjacent end face cover plate 74 over lubricant groove 72. As known in the art, such adhesion can be achieved by applying the material 76 to grease applied to the mold surface to which it is to be adhered. Even when the material 76 covers the exit ends of the lubricant passages from groove 72, this does not prevent the lubricant from performing its function in the mold. Instead, the lubricant seeps through the material 76, which is porous, and thereby soaks the material with lubricant all the way down to its lower edge, which may be slightly below the surface of the molten metal 28 above the ingot, but slightly above the freeze line where the top edge of the ingot 30 touches the chilled mold face 58. It has been found that the use of the material 76 in this manner improves the smoothness of the long sides of ingots case in molds such as that described above, particularly in the case of alloys 2024 and 7075. Such combined use of the material 76 can also be applied advantageously in other molds, particularly of the DC-type.

While present preferred embodiments of the invention and methods of practicing the invention have been illustrated and described, it will be understood that the invention may be otherwise embodied and practiced within the scope of the following claims:

What is claimed is:

1. A continuous casting mold for vertical casting, having a horizontal inlet through the side of the mold for introducing molten metal, said inlet being defined by a body having a passageway therethrough, means for insulating said body from adjacent chilled portions of the mold, an interior surface of the mold against which the molten metal is initially to be frozen to form an ingot, said surface extending around the mold beneath said inlet-forming body and upwardly on both sides of said inlet-forming body, means to chill said interior surface of the mold, and means to apply coolant directly to the ingot as it emerges from the mold, said means to chill said interior surface of said mold for freezing the ingot initially along the upper interior surface of the mold on the sides of said inlet-forming body, while freezing the ingot at a lower level along said surface beneath said body.

2. The casting mold of claim 1, wherein is included a molten-metal supply means for supplying molten metal to said inlet-forming body.

3. The casting mold of claim 2, wherein said molten-metal supply means is adjacent the mold, at a level sufficient for the molten metal to flow into the mold through said passageway, the lower surface of said passageway being effective as a weir over which the molten metal passes into the mold.

4. The casting mold of claim 2, adapted for underfeeding molten metal into the mold through said inlet passageway, said molten-metal supply means being adjacent the mold at a level sufficient to keep the passageway submerged, so that the upper level of molten metal in the mold remains above said passageway during the casting operation.

5. The casting mold of claim 1, having a plurality of inlet-forming bodies defining peripherally spaced inlet, passageways said bodies being symetrically disposed around the mold and each being insulated from adjacent chilled portions of the mold, said interior surface of the mold extending upwardly between said bodies above the level of said inlet passageways.

6. A continuous casting mold for vertical casting, having two relatively long sides opposite each other and two relatively short sides opposite each other, a horizontal inlet passageway through each of the opposite shorter sides for entry of molten aluminum into the mold, each of said inlet passageways being formed in a body, means for insulating said bodies from adjacent chilled mold portions, mold faces extending around the interior of the mold, against which the molten metal in the mold is initially to be frozen, means to chill said mold faces, and means to apply coolant directly to the ingot emerging from the mold, said means to chill said mold faces for freezing the ingot initially along the chilled mold faces of the longer sides of the mold at a level close to the top level of the molten metal in the mold on the sides of said inlet forming bodies, while freezing the ingot initially at a lower level along the shorter sides of the mold beneath said inlet forming bodies.

7. The casting mold of claim 6 wherein said inlet passageways at the shorter opposite sides of the mold are disposed below the normal level of molten metal in the mold; and means for supplying molten metal adjacent the mold at a level sufficient to keep the inlet passageways submerged.

8. The casting mold of claim 6 wherein the chilled mold faces of the longer opposite sides of the mold extend upwardly above the level of said inlet passageways.

9. The casting mold of claim 6, having a recess cut into the upper portion of the mold wall at each of the shorter opposite sides thereof, said inlet-forming bodies being mounted in such recesses.

10. The casting mold of claim 6 wherein each of said bodies is a block of heat-insulating material having at least one passageway therethrough forming said molten metal inlet passageway through the block.

11. The casting mold of claim 6 wherein each of the opposite longer sides of the mold comprises a metal mold wall having a chilled inner face, an adjacent manifold to receive coolant, and outlet passageways from said manifold for directing coolant against the ingot.

12. The casting mold of claim 11 wherein each of the opposite shorter sides of the mold comprises a metal mold wall having a chilled inner face, an adjacent manifold to receive coolant, and outlet passageways from said manifold for directing coolant against the ingot.

13. The casting mold of claim 12, said coolant outlet passageways at the shorter sides being at substantially the same level in the mold as those at the longer sides thereof.

14. The casting mold of claim 6, wherein said inlet-forming bodies are constructed of heat-insulating material having the molten-metal inlet passageways therein, said bodies being disposed above the chilled inner face of the mold wall along the shorter sides thereof, and said chilled inner faces of the mold wall along the opposite longer sides extending upwardly in the mold above the level of said inlet passageways.

15. The casting mold of claim 14; said inlet-forming bodies having inner faces extending substantially along the plane of the adjacent chilled surfaces of the mold at the shorter sides thereof.

* * * * *